US010843828B2

(12) United States Patent
Hyska et al.

(10) Patent No.: US 10,843,828 B2
(45) Date of Patent: Nov. 24, 2020

(54) PACKAGING METHOD AND LINE FOR IMPROVED FINISHED PRODUCT

(71) Applicant: Paper Converting Machine Company, Green Bay, WI (US)

(72) Inventors: David J. Hyska, Green Bay, WI (US); John C. Odegard, Green Bay, WI (US); Robert J. Dunstan, Jr., Green Bay, WI (US); Brian L. Christman, Denmark, WI (US)

(73) Assignee: PAPER CONVERTING MACHING COMPANY, Green Bay, WI (US)

( * ) Notice: Subject to any disclaimer, the term of this patent is extended or adjusted under 35 U.S.C. 154(b) by 0 days.

(21) Appl. No.: 16/442,055

(22) Filed: Jun. 14, 2019

(65) Prior Publication Data

US 2020/0231314 A1 Jul. 23, 2020

Related U.S. Application Data

(60) Provisional application No. 62/795,128, filed on Jan. 22, 2019.

(51) Int. Cl.

| | |
|---|---|
| ***B65B 11/10*** | (2006.01) |
| ***B65B 65/00*** | (2006.01) |
| ***B65B 41/12*** | (2006.01) |

(52) U.S. Cl.

CPC ..... *B65B 11/105* (2013.01); *B65B 41/12* (2013.01); *B65B 65/003* (2013.01)

(58) Field of Classification Search

CPC ..... B65B 25/146; B65B 25/148; B65B 9/067; B65B 9/073; B65B 35/40; B65B 35/405; B65B 65/003; B29C 66/4322

(Continued)

(56) References Cited

U.S. PATENT DOCUMENTS 4,045,946 A * 9/1977 Schaefer ..... B65B 9/2028 53/550
4,679,379 A * 7/1987 Cassoli ..... B65B 9/073 100/232

(Continued)

FOREIGN PATENT DOCUMENTS

| | | |
|---|---|---|
| DE | 1174684 B | 7/1964 |
| EP | 1155961 B1 | 9/2008 |
| EP | 1771335 B1 | 9/2008 |

OTHER PUBLICATIONS

International Search Report and Written Opinion for PCT/US2020/012474 dated Mar. 30, 2020.

*Primary Examiner* — Hemant Desai
*Assistant Examiner* — Valentin Neacsu
(74) *Attorney, Agent, or Firm* — Thompson Coburn LLP

(57) ABSTRACT

An overwrap feed station wraps a product with an overwrap material by drawing the overwrap material around the product to form a tube around the product as the product moves through the feed station. The feed station is configurable in one of first and second configurations based upon a desired location of a longitudinal seal to be formed on the tube around the product. A first former is configured to guide the overwrap material through the entrance of the feed station so that longitudinal edges of the overwrap material overlap on a first side of the tube during wrapping of the product. The second former is configured to guide the overwrap material through the entrance of the feed station so that longitudinal edges of the overwrap material overlap on a second side of the tube during wrapping of the product. The second side is transverse to the first side.

22 Claims, 13 Drawing Sheets

(58) Field of Classification Search
USPC ..... 53/450, 443, 455, 543, 550; 414/791.6
See application file for complete search history.

(56) References Cited

U.S. PATENT DOCUMENTS

| | | | | |
|---|---|---|---|---|
| 5,165,221 | A | 11/1992 | Udelson et al. | |
| 5,377,478 | A | 1/1995 | Kovacs et al. | |
| 5,433,063 | A * | 7/1995 | Kovacs | B65B 9/067 53/374.5 |
| 6,250,048 | B1 | 6/2001 | Linkiewicz | |
| 6,408,600 | B1 | 6/2002 | Nankervis et al. | |
| 7,143,567 | B2 * | 12/2006 | Omo | B65B 25/146 53/443 |
| 7,155,883 | B2 | 1/2007 | Baldanza et al. | |
| 7,356,978 | B2 * | 4/2008 | Dall'Omo | B65B 25/143 53/450 |
| 2002/0184857 | A1 * | 12/2002 | O'Connor | B65B 61/182 53/412 |
| 2005/0166552 | A1 * | 8/2005 | Omo | B65B 25/146 53/443 |
| 2007/0125242 | A1 * | 6/2007 | Dall'Omo | B65B 25/146 99/450.4 |
| 2007/0137145 | A1 * | 6/2007 | Dall'Omo | B65B 25/143 53/452 |
| 2008/0209866 | A1 * | 9/2008 | Dall'Omo | B65B 25/143 53/550 |
| 2013/0097965 | A1 | 4/2013 | Honegger | |
| 2015/0329230 | A1 * | 11/2015 | Rasi | B65B 25/146 53/443 |
| 2019/0291900 | A1 * | 9/2019 | Persson | B65B 9/2021 |

* cited by examiner

PACKAGING METHOD AND LINE FOR IMPROVED FINISHED PRODUCT

RELATED APPLICATION DATA

This application claims the benefit of U.S. provisional application Ser. No. 62/795,128, filed Jan. 22, 2019, the disclosure of which is incorporated by reference herein.

SUMMARY AND BACKGROUND

The disclosure is directed to a packaging line having an overwrap material infeed station that is adapted and configured to package rolls or packs of toilet tissue or towels with an overwrap material which the seal that joins the two ends of the overwrap material may be formed on a horizontal face or vertical face of the tubular package as desired. Thus, one machine is capable of forming the longitudinal seal on either a vertical face or side face of the wrapped package of product, as desired. Although the description that follows below involves the wrapping and packaging of rolls, for instance, toilet tissue and paper towels, the principles of the disclosure may be used in connection with packaging lines used for packaging other products with an overwrap material where the seal location may vary depending upon product format. Further, the rolls or packs wrapped within the overwrap material may be delivered to the overwrap infeed station in multiple orientations not limited to what is shown in the drawings.

DETAILED DESCRIPTION

Figure 1:
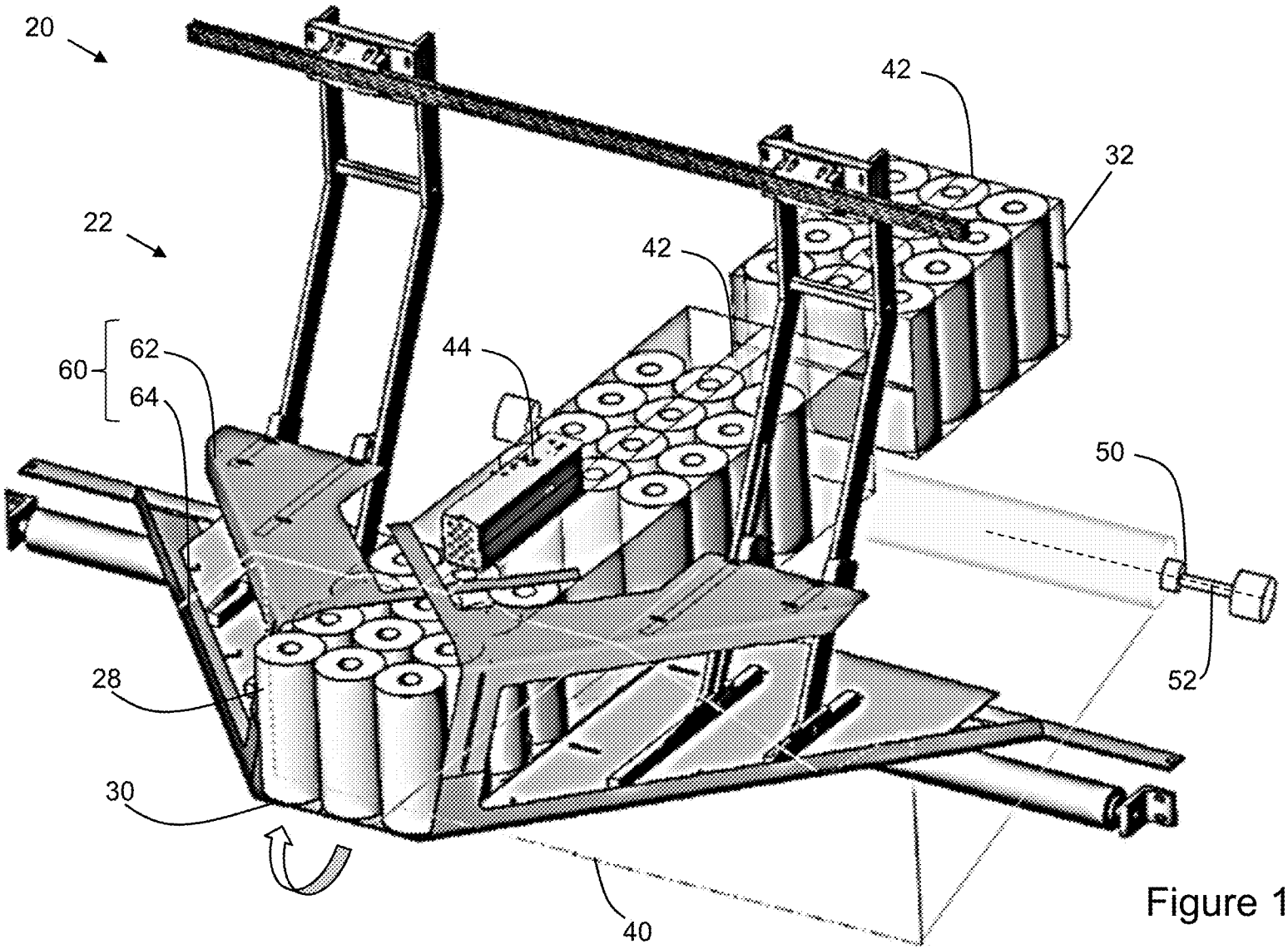
FIG. 1 is a partial, perspective view of an embodiment of a portion of a packaging line comprising an overwrap infeed station configured to receive overwrap material travelling in a generally horizontal format (the width is horizontal) toward an entrance of the overwrap infeed station and to apply a longitudinal seal to a package of product wrapped with the overwrap material at a position generally opposite of (at 180 degrees from) the side of the entrance to which the overwrap material is directed.
Figure 2:
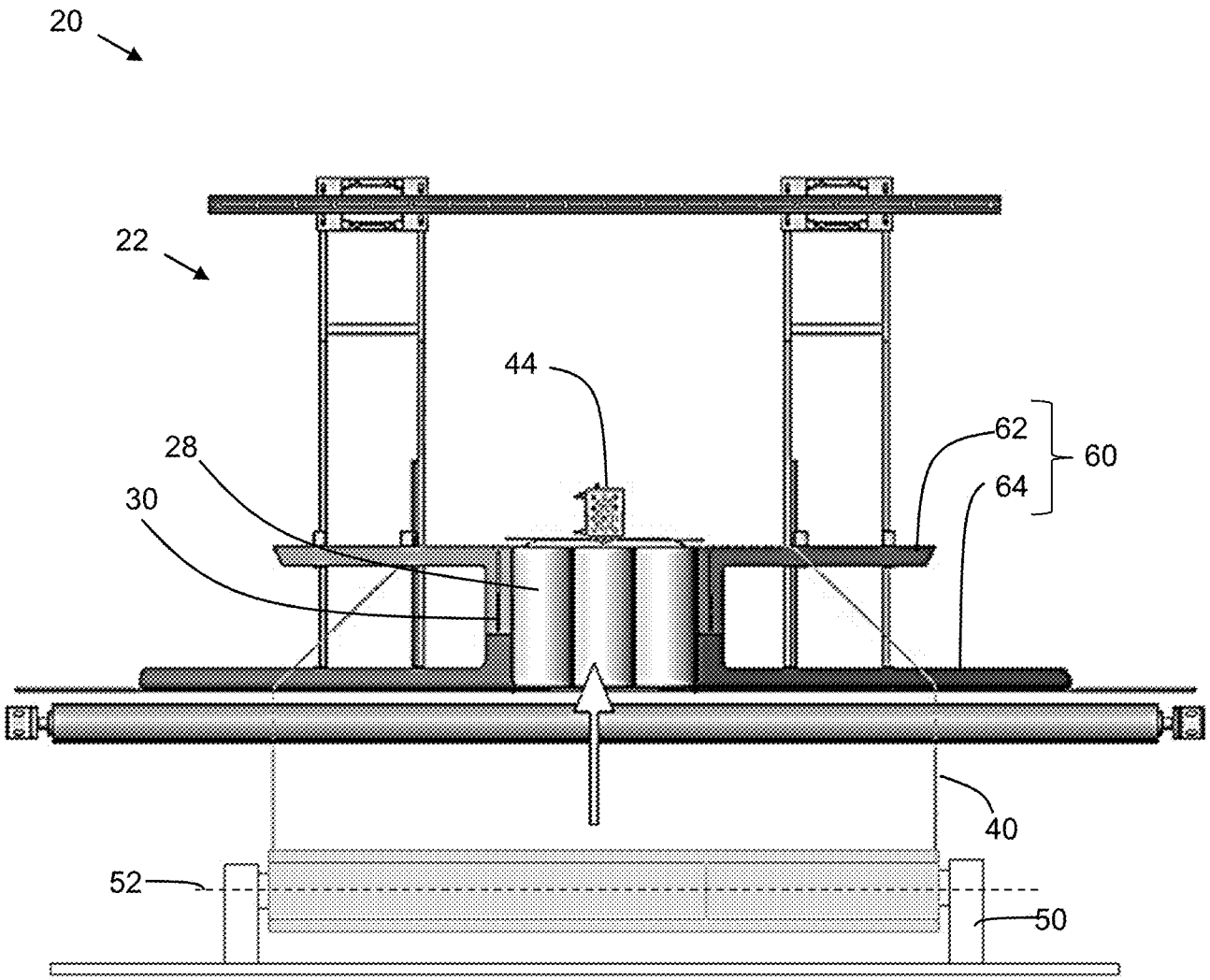
FIG. 2 is partial front view of the portion of the packaging line of FIG. 1 showing the package of the product to be wrapped with the overwrap material entering an entrance of the overwrap feed station where the seal to be applied to the package of the product is at a position generally opposite of (at 180 degrees from) the side of the entrance to which the overwrap material is directed.
Figure 3:
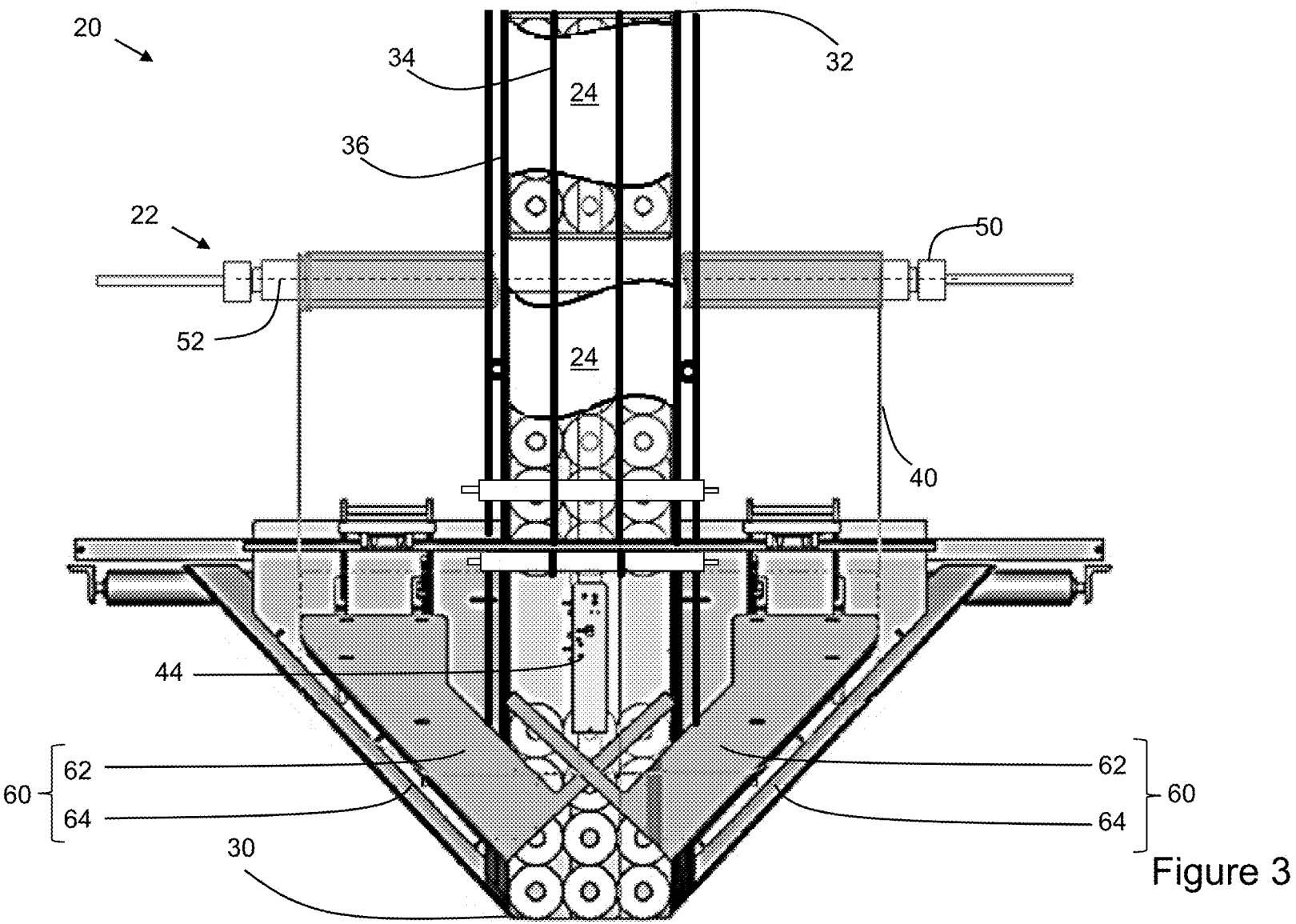
FIG. 3 is a partial top view of the portion of the packaging line of FIG. 1 with a top support of the overwrap station shown partially removed to provide additional detail of the wrapped product.
Figure 4:
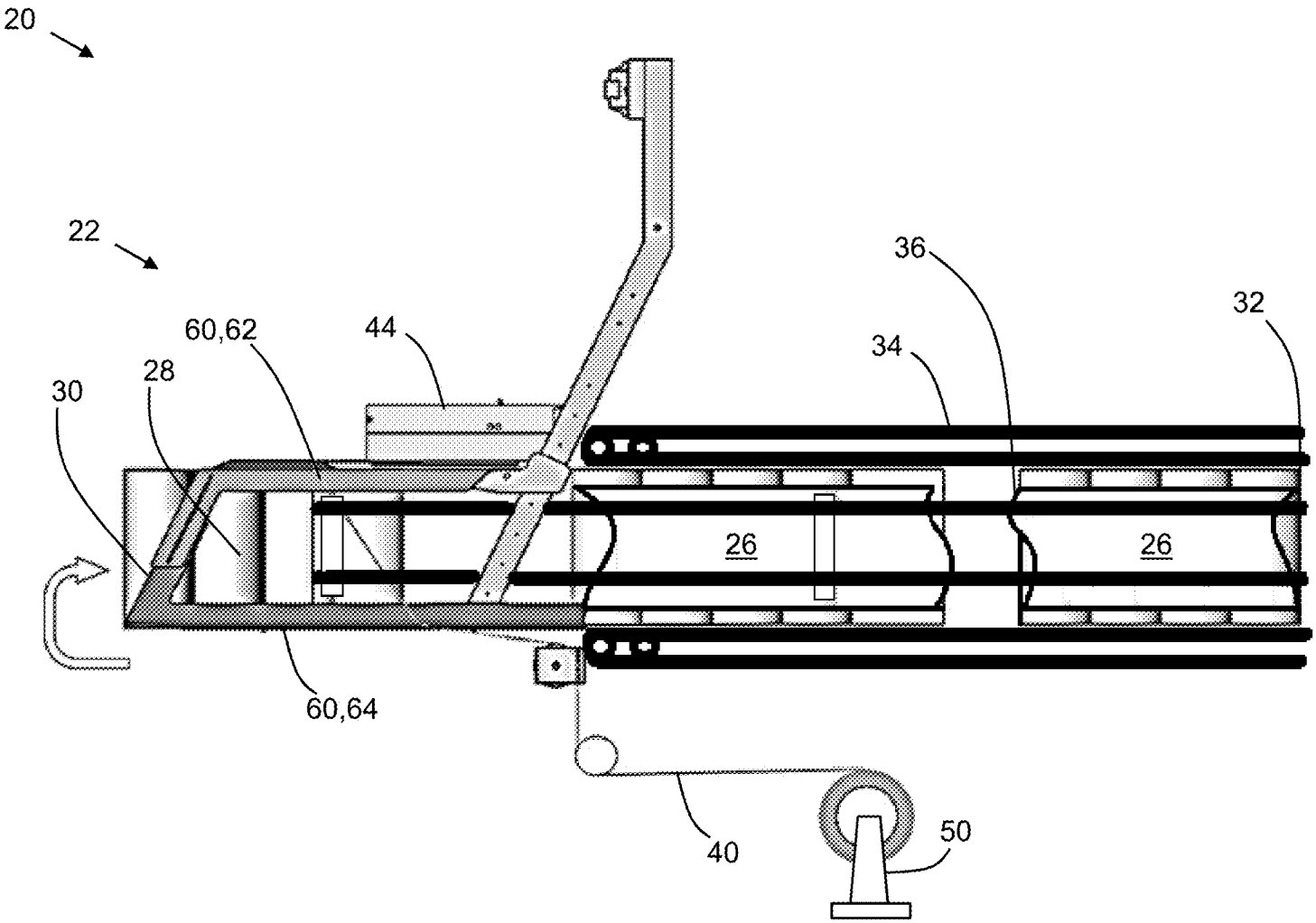
FIG. 4 is a partial right side view of the portion of the packaging line of FIG. 1 with a side support of the overwrap station shown partially removed to provide additional detail of the wrapped product.

FIGS. 1-5 generally show partial views of a packaging line 20 with an overwrap feed station 22 in one configuration. FIGS. 6-7 generally show partial views of a packaging line 120 with an overwrap feed station 122 in another configuration. FIGS. 8-13 generally show partial views of a packaging line 220 with an overwrap feed station 222 in another configuration. Although not shown in all of the views, the packaging line overwrap feed station 22,122,222 generally has left and right vertical supports, and bottom and top horizontal supports that define an enclosure with a hollow interior for the overwrap feed station. For purposes of illustration, FIGS. 3 and 4 show typical top supports 24 and right side supports 26 albeit in cut-away to provide additional detail of the product configuration as it is being wrapped. Similar supports may be provided on the left and bottom sides. For ease of illustration, the supports are otherwise not shown in the views of the Figures. Product 28,128,228 to be wrapped moves through the enclosure of the overwrap feed station 22,122,222 from an entrance 30,130,230 to a discharge 32,132,232 of the overwrap feed station.

The product 28,128,228 may move through the enclosure of the overwrap feed station 22,122,222 via a conveyor, which may be integrated with the enclosure. The conveyor may be a belt and/or roller conveyor. For purposes of illustration and not in any limiting sense, FIGS. 3 and 4 show top and right side belt conveyors 34,36. Similar conveyors may be provided on the left and bottom sides. For ease of illustration, the conveyors are otherwise not shown in the views of the Figures. The product to be wrapped may also move through the enclosure via a vacuum or through over pressure. The vacuum or over pressure may be coupled with conveyor, for instance, a belt and/or roller conveyor, which may be integrated with the enclosure. The product to be wrapped may also move through the enclosure with a pushing or pulling mechanism. In integrating the conveyor with the enclosure, the conveyor may be arranged on at least one of the left vertical support, right vertical support, top horizontal support, and bottom horizontal supports of the enclosure. To provide even feeding, the conveyor may be arranged on both vertical supports and/or both horizontal supports. There may be a part of the conveyor on the vertical supports for a portion of enclosure and part of the conveyor on the horizontal supports for another portion of the enclosure. In one aspect, driven belts grab the product as it enters into the enclosure to pull the product evenly with the overwrap material 40.

The overwrap feed station 22,122,222 receives at the entrance 30 the overwrap material 40 for the product 28,128, 228 to be packaged in a tube of overwrap material. By way of example and not in any limiting sense, the overwrap material 40 may be a polyethylene film. As the product 28,128,228 to be wrapped moves through the enclosure of the overwrap feed station 22,122,222, the overwrap material 40,140,240 is drawn around the product to form a tube of the overwrap material around the product. As will be described in more detail below, the single overwrap feed station 22,122,222 may be configured in several configurations depending upon the desired location of the longitudinal seal used to form the package containing the product 28,128,228.

Figure 5:
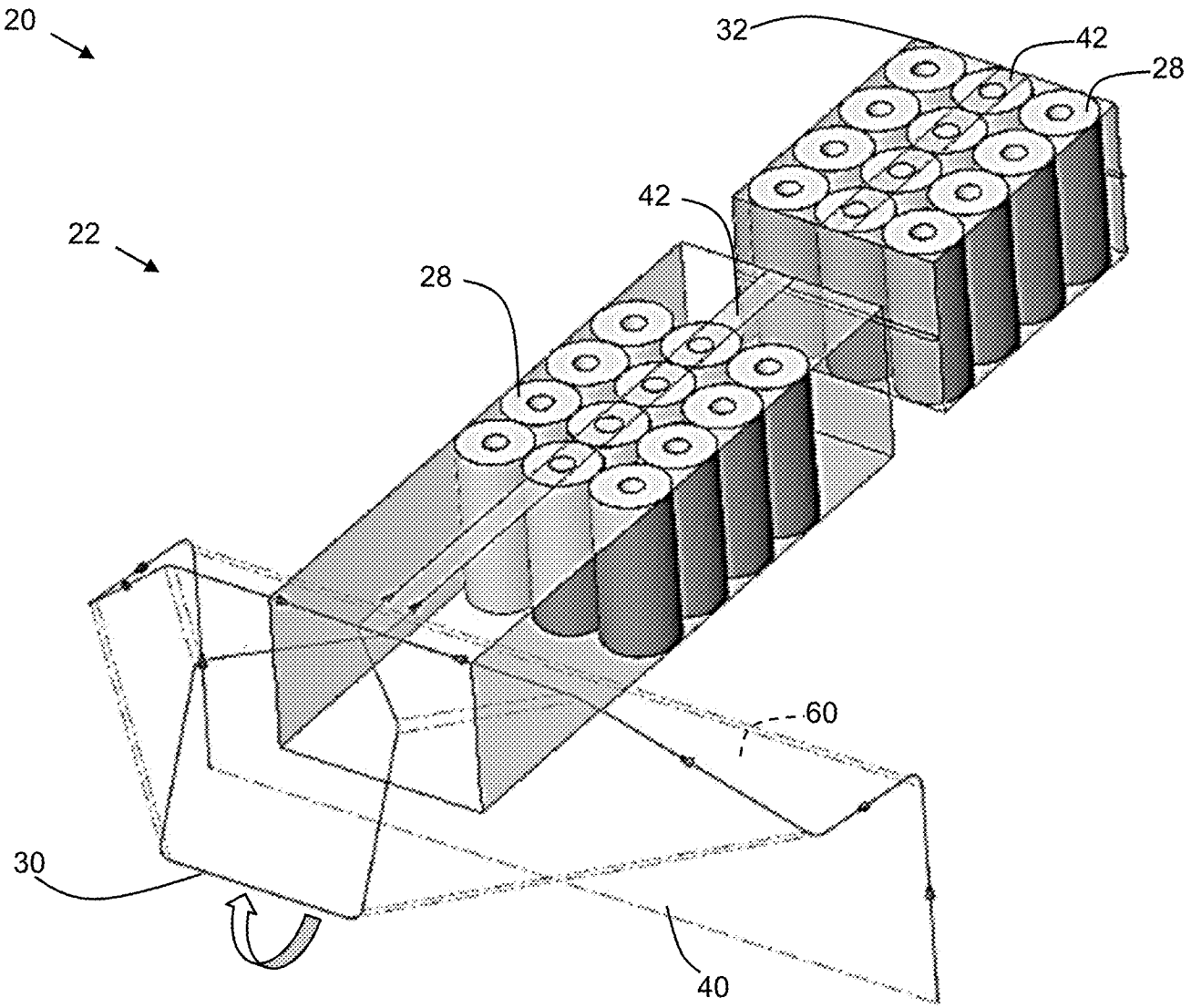
FIG. 5 is a partial, perspective schematic view of the packaging line of FIG. 1 providing additional detail of the path of the overwrap material into the entrance of the overwrap feed station.
Figure 6:
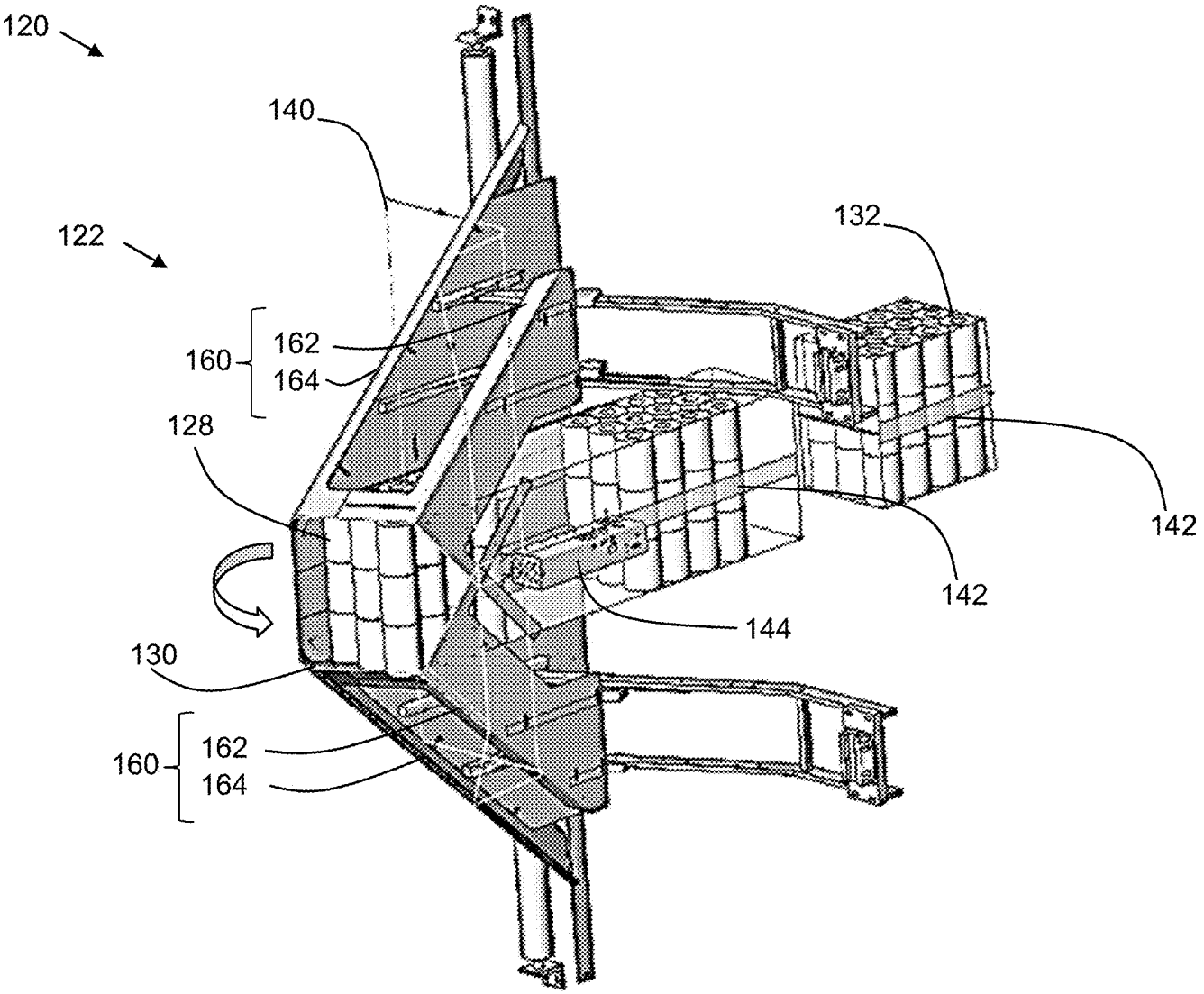
FIG. 6 is a partial, perspective view of the portion of the packaging line of FIG. 1 oriented in second configuration in which the overwrap feed station is rotated 90 degrees relative to the embodiment shown in FIG. 1 but where the seal to be applied to the package of the product is at a position generally opposite of (at 180 degrees from) the side of the entrance to which the overwrap material is directed.
Figure 7:
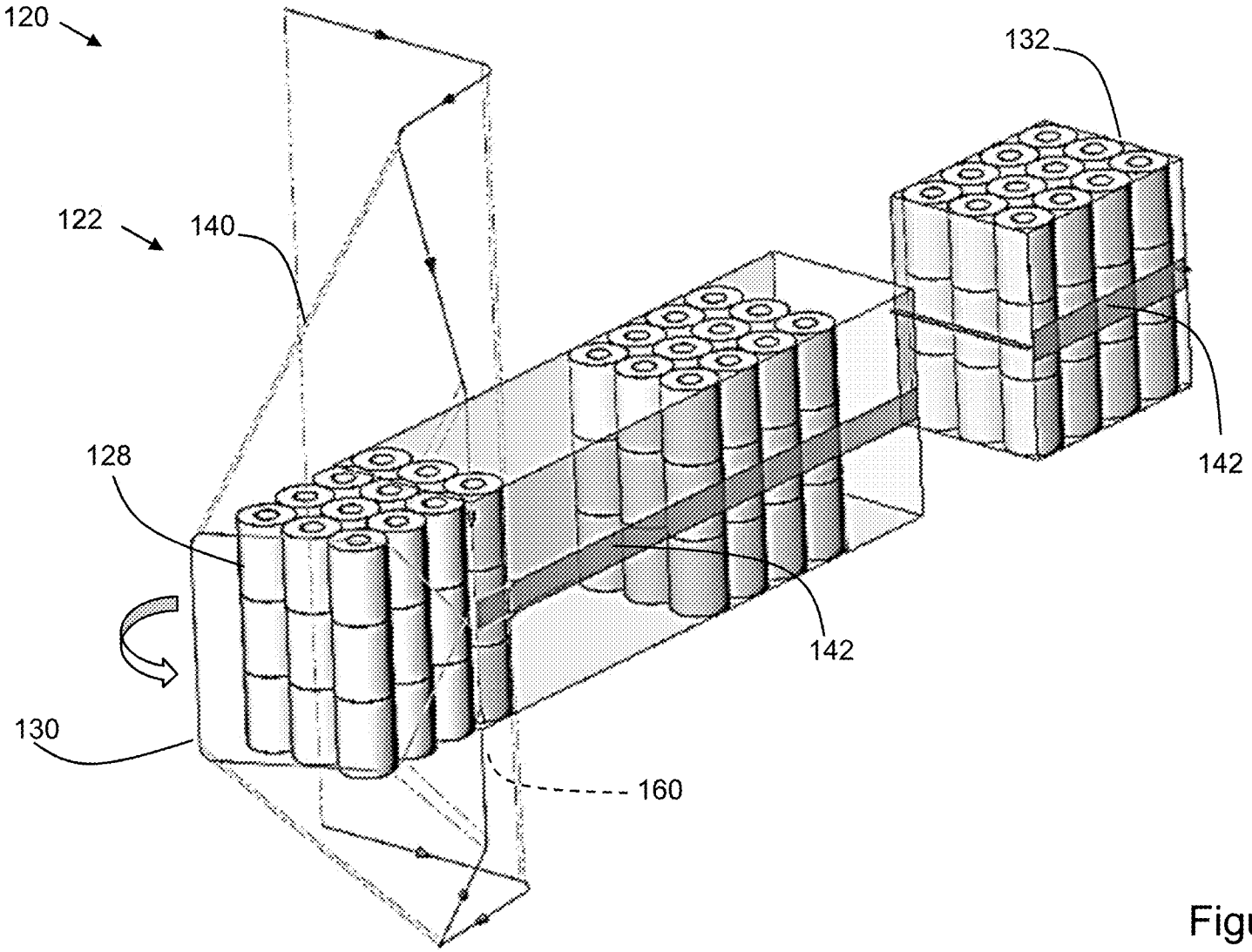
FIG. 7 is a partial, perspective schematic view of the packaging line of FIG. 6 providing additional detail of the path of the overwrap material into the entrance of the overwrap feed station.

In one configuration of the overwrap feed station 22,122, which is shown by way of example in FIGS. 1-7, the wrapped rolls or packs of products 28,128 may have its seal 42,142 on a face of the tubular package configuration which is generally opposite of (180 degrees from) the side of the entrance 30,130 of the overwrap feed station to which the overwrap material was directed. The longitudinal seal 42 may be created by heating the adjacent and overlapping longitudinal edges to fuse the edges to together and then directing cooling air over the fused edges to cure the seal. The seal 42 may also be created by a fin seal, or gluing or bonding the edges or flaps on the longitudinal edges of the overwrap material. The seal may also be created by ultrasonically welding the edges or flaps on the longitudinal edges of the overwrap material or by applying a heated element directly against the longitudinal edges of the film. Additionally, lasers could also be used to weld the edges together. A longitudinal seal unit 44 for forming the desired seal (e.g., heat, glue, ultrasonic, etc.) may be provided in the hollow interior of the enclosure on supports adjacent to the desired location of the seal. For instance, FIGS. 1-5 show the overwrap material 40 being unwound from an unwind stand 50 about a horizontal axis 52 and being directed to the entrance 30 of the overwrap feed station 22 from generally the bottom of the overwrap feed station with a width of the overwrap material being oriented horizontally. The longitudinal seal unit 44 forms the seal adjacent to the top horizontal support of the overwrap feed station 22 on the top face of the package of wrapped product 28 which is generally opposite of (180 degrees from) the bottom horizontal support and where the overwrap material entered the entrance to the overwrap feed station. FIGS. 6-7 show an alternate embodiment where the overwrap material 140 is being directed to the entrance 130 of the overwrap feed station 122 from generally the left side of the overwrap feed station (as shown in Figures or facing the entrance to the overwrap feed station). The longitudinal seal unit 144 forms the seal 142 adjacent to the right vertical support of the overwrap feed station on the right vertical face of the package of wrapped product, which is generally opposite of (180 degrees from) the left vertical support and where the overwrap material entered the entrance to the overwrap feed station. While FIGS. 1-5 show the unwind stand 50 having a horizontal center axis 52 for unwinding, and the overwrap material travelling to the entrance of the overwrap feed station in a generally horizontal format (i.e., the width arranged horizontally), the overwrap material may be unwound from the unwind stand at an angle or vertically and may be oriented as desired prior to being guided into the entrance of the overwrap feed station with turn bars. For instance, in the embodiment of FIGS. 6-7, the overwrap material 140 may be unwound from an unwind stand (not shown) about a vertical axis so the overwrap material may travel to the entrance of the overwrap feed station in a generally vertical plane with one longitudinal edge vertically above the other across a width of the overwrap material (i.e., the width of the overwrap material extending vertically). In the alternative to that described above relative to FIGS. 6 and 7, the overwrap material may be unwound from an unwind stand about a horizontal axis and may be initially directed to the entrance of the overwrap feed station in a generally horizontal format with the longitudinal edges of the overwrap material at the same vertical distance across the width (i.e., the width of the overwrap material extending horizontally), and a 45 degree turn bar may be used to reorient the overwrap material prior to being guided into the entrance of the overwrap feed station. In both embodiments of FIGS. 1-5 and 6-7, the overwrap material 40,140 may be directed to the entrance of the overwrap feed station, and a former 60,160 arranged around the entrance 30,130 of the overwrap feed station 22,122 may guide the overwrap material into the hollow interior of the enclosure. As the overwrap feed station 22,122 draws the overwrap material 40,140 into and through the hollow interior of the enclosure with the product 28,128 to be packaged, the former 60,160 manipulates the overwrap material so that the opposite longitudinal edges of the overwrap material 40,140 are brought adjacent to and overlapping with one another on a side of the overwrap feed station opposite of the side from which the overwrap material was directed to the entrance of the overwrap feed station. Thus, the longitudinal seal unit 44,144 may be arranged (and the resultant longitudinal seal 42,142 may be formed) on the side of the overwrap feed station opposite of the side from which the overwrap material 40,140 was directed to the entrance 30,130 of the overwrap feed station, and may be placed on the package on the side of the package opposite of the side from which the overwrap material was directed to the entrance of the overwrap feed station. For instance, as best shown in FIG. 5, the seal 42 is formed on the top face of the tubular package roughly 180 degrees from the center of the bottom face of the package which is the general direction from which the overwrap material was directed to the entrance of the overwrap feed station. In FIG. 7, the seal 142 is formed roughly 180 degrees from the center of the left face of the package which is the general direction from which the overwrap material was directed to the entrance of the overwrap feed station.

Figure 8:
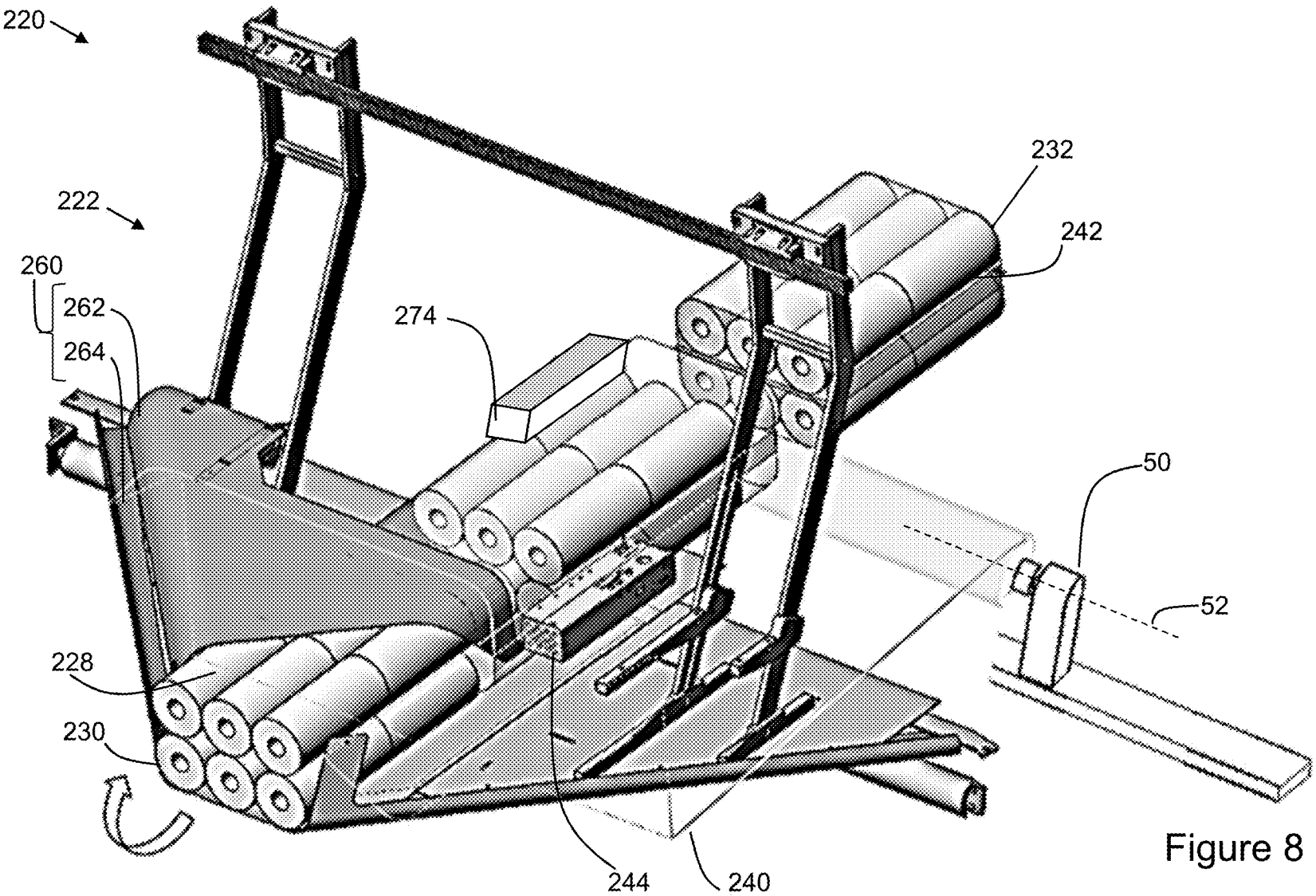
FIG. 8 is a partial, perspective view of another embodiment of a portion of a packaging line comprising an overwrap infeed station configured to receive overwrap material travelling in a generally horizontal format (the width is horizontal) toward an entrance of the overwrap infeed station and to apply a longitudinal seal to a package of product wrapped with the overwrap material at a position generally at 90 degrees (or 270 degrees) from the side of the entrance to which the overwrap material is directed.

In a second configuration of the packaging line 220 with an overwrap infeed station 222, which is shown by way of example in FIGS. 8-13, the wrapped rolls or packs of products 228 may have its seal 242 on a face of the tubular package configuration which is generally 90 degrees (or 270 degrees) from the side of the entrance 230 to which the overwrap material 240 was directed to the entrance of the overwrap feed station. The former 260 adjacent the entrance 230 of the overwrap feed station is adapted and configured to direct the overwrap material 240 for packaging the product to be packaged through the hollow interior of the enclosure with longitudinal edges of the overwrap material overlapping each other adjacent to one of the left and right vertical support. Again, the longitudinal seal 242 may be created by heating the adjacent and overlapping longitudinal edges to fuse the edges to together and then directing cooling air over the fused edges to cure the seal, or using one of the aforementioned other methods. A longitudinal seal unit 244 may be provided in the hollow interior of the enclosure on supports adjacent to the desired location of the seal. For instance, FIGS. 8-13 show the overwrap material 242 being unwound from an unwind stand 50 about a horizontal axis 52 and being directed to the entrance of the overwrap feed station 230 from generally the bottom of the overwrap feed station in a horizontal format. As best shown in FIG. 8, the longitudinal seal unit 244 forms the seal 242 adjacent to the right horizontal support of the overwrap feed station 222 on the right face of the package of wrapped product. In the embodiment of FIGS. 8-13, the overwrap material 240 is delivered to the entrance 230 of the overwrap feed station 222 in a manner similar to that shown in FIGS. 1-5, but the overwrap material comes together on a vertical side of the package rather than adjacent to the horizontal supports of the overwrap feed station.

Figure 9:
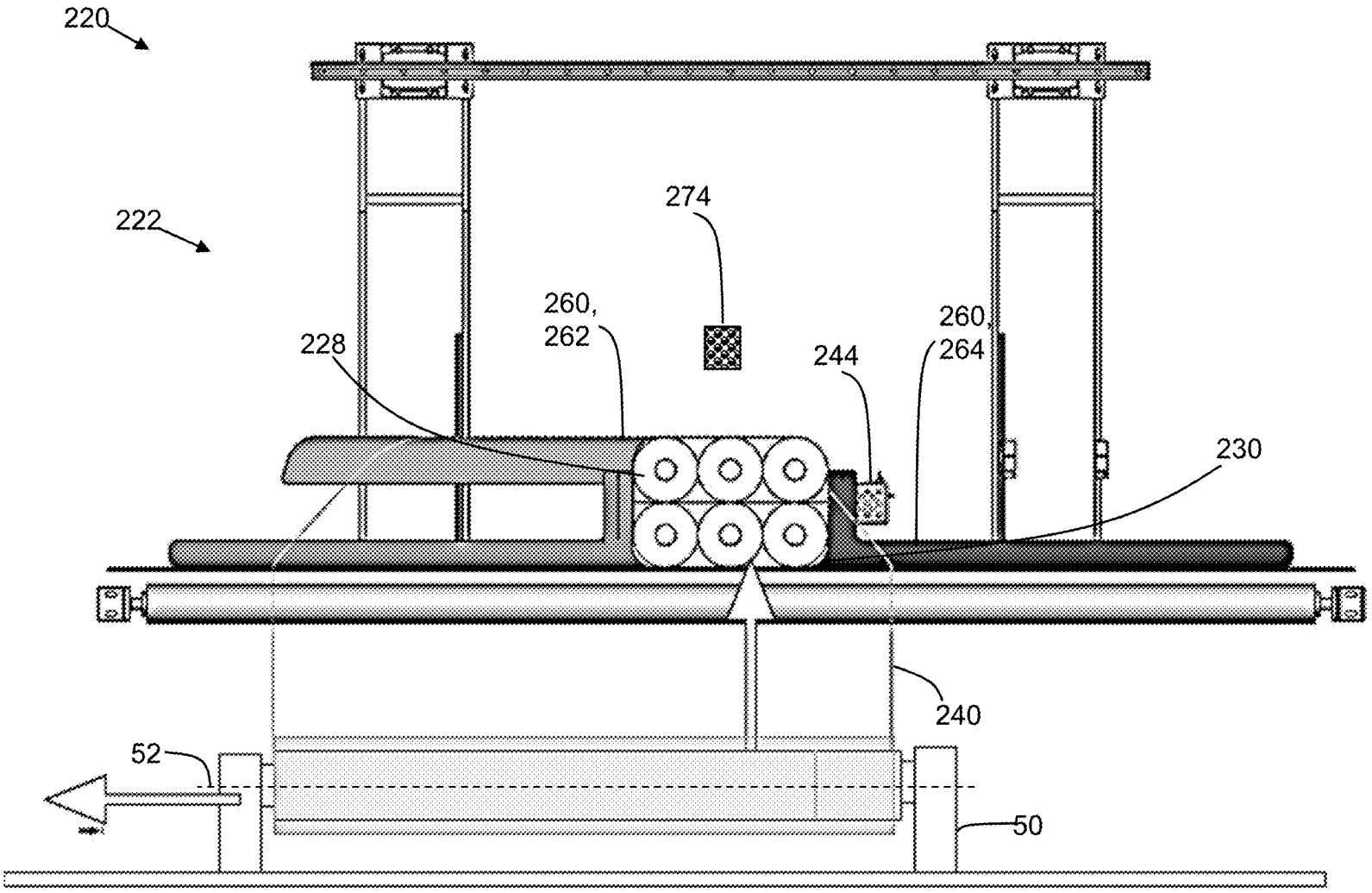
FIG. 9 is a partial front view of the portion of the packaging line of FIG. 8 showing the package of the product to be wrapped with the overwrap material entering an entrance of the overwrap feed station where the seal to be applied to the package of the product is at a position generally at 90 degrees (or 270 degrees from) the side of the entrance to which the overwrap material is directed.
Figure 10:
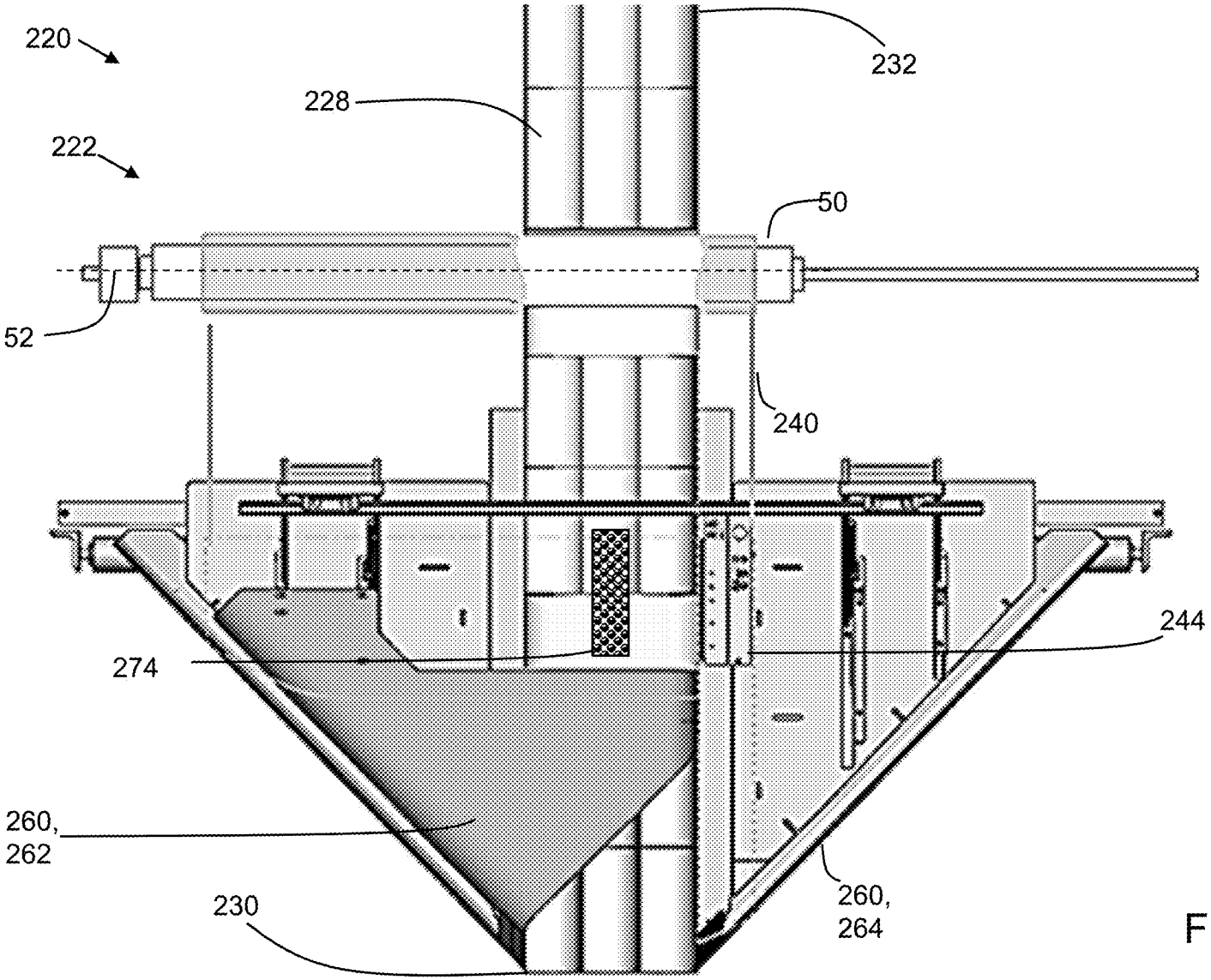
FIG. 10 is a partial top view of the portion of the packaging line of FIG. 8.
Figure 11:
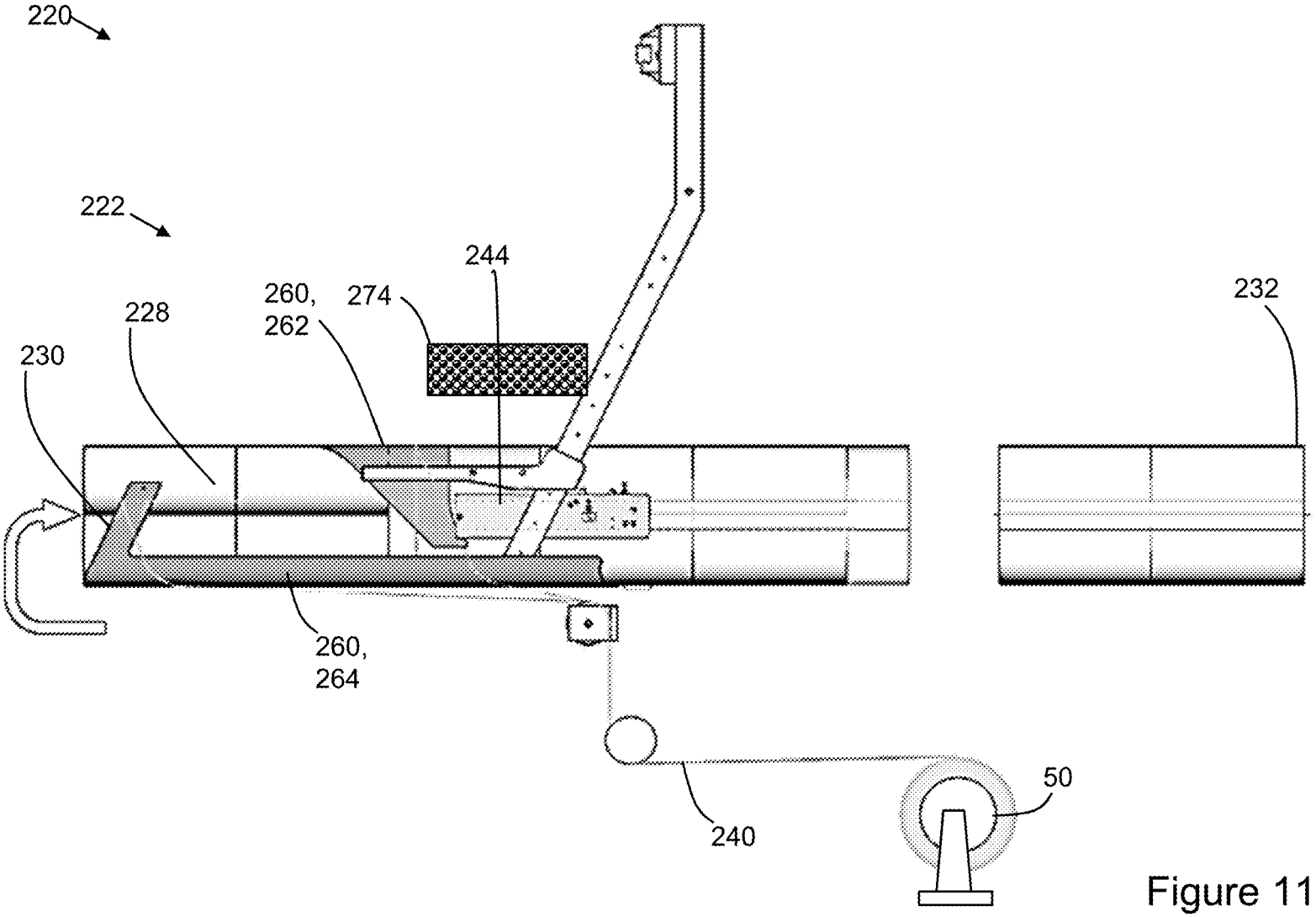
FIG. 11 is a partial right side view of the portion of the packaging line of FIG. 8.
Figure 12:
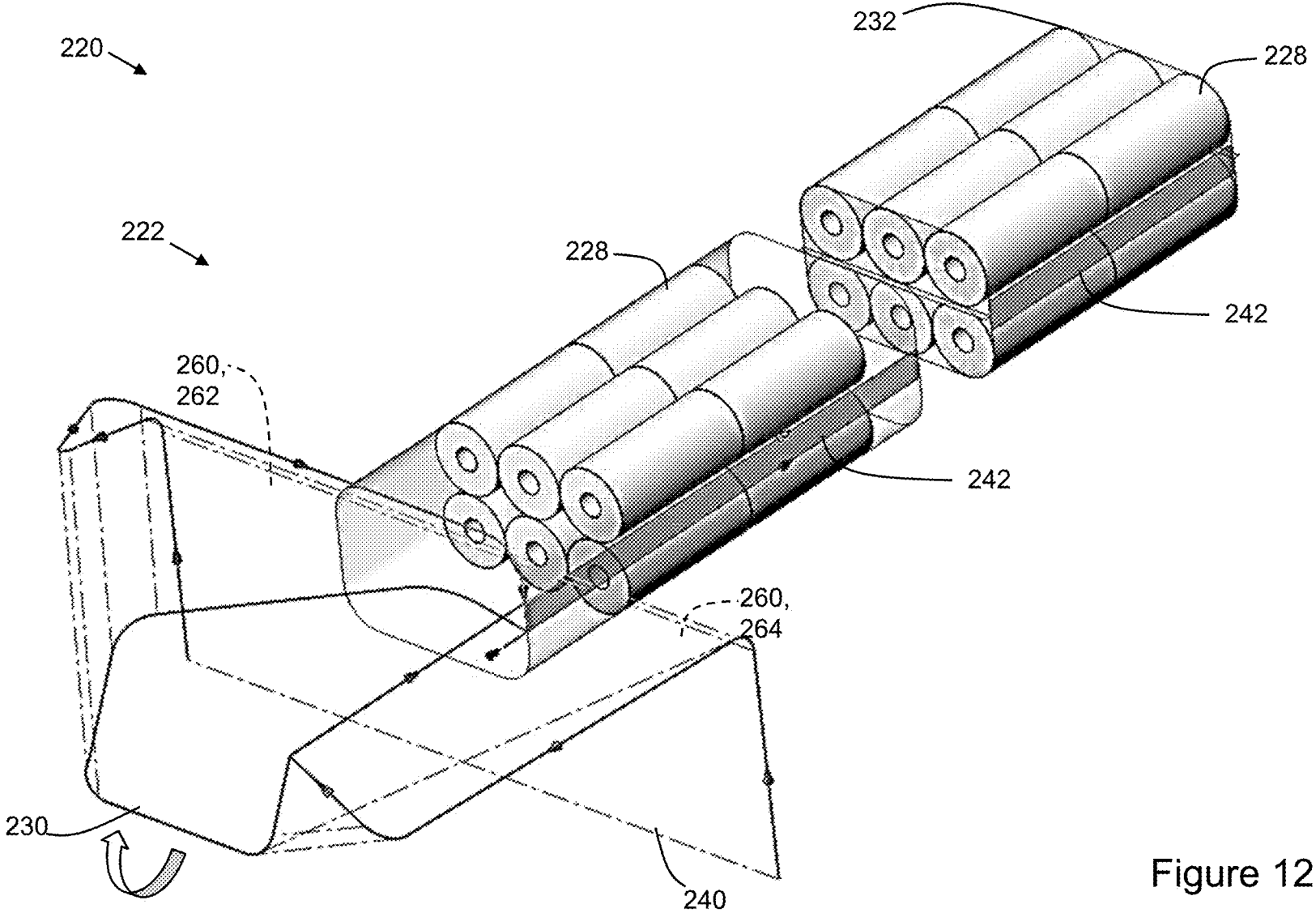
FIG. 12 is a partial, perspective schematic view of the packaging line of FIG. 8 providing additional detail of the path of the overwrap material into the entrance of the overwrap feed station.

The former of FIGS. 8-13 creates a very short path on one side of the tubular package of the product 228 (about 90 degrees from the side of the entrance of the overwrap feed station from which the overwrap material enters), and a much longer path around the other side of the tubular package of the product (about 270 degrees from the side of the entrance of the overwrap feed station from which the overwrap material enters). To assist in moving the opposite longitudinal edges to become adjacent and overlapping with each other on a side 90 degrees from the side to which the overwrap material enters the overwrap feed station, the overwrap material 240 may be significantly offset relative to the entrance 230 such that the longitudinal edges overlap on a side 90 degrees from the side to which the overwrap material enters the overwrap feed station. For instance, by way of example as shown in FIGS. 8-13, the overwrap material 240 may be unwound from an unwind stand 50 about a horizontal axis 52 and may be directed to the entrance 230 of the overwrap feed station 222 in a generally horizontal format with the longitudinal edges of the overwrap material at the same vertical distance across the width (i.e., the width of the overwrap material extending horizontally), which is the general form of unwinding shown in FIGS. 1-5. However, in FIGS. 8-13, the relative position of the overwrap material 240 on the unwind stand may be significantly shifted in the direction of the center axis 52 of unwind stand 50 so that the overwrap material is guided to the entrance of the overwrap feed station significantly off center. In FIG. 9, the roll of overwrap material 240 on the unwind stand 50 has been shifted to the left. Thus, the same manner of delivery of the overwrap material and the same unwind stand may be used regardless of the whether the application process calls for the longitudinal seal to be formed on a horizontal face or vertical face of the tubular package. By way of example, the unwind stand 50 may be placed be on linear rails and moved perpendicular to the direction of the flow the overwrap material 240 as it is being unwound from the stand. In a further example, the overwrap material 240 may be wound on a mandrel and the mandrel may be disposed on a spindle with the spindle disposed on a linear slide. The linear slide may be movable along a direction of the center axis 52 of the spindle between a position in which the overwrap material is centered relative to the entrance of the overwrap feed station and off center relative to the entrance of the overwrap feed station. Thus, for both orientations of the longitudinal seal, the same unwind stand 50 may be used and the overwrap material 40,140,240 may follow the same general flow path being fed underneath the overwrap feed station, which is out of the way and less inconvenient for an operator when operating the overwrap feed station.

For the ease of illustration, a single roll of overwrap film 240 is shown on an unwind stand 50. A double drum unwind stand may also be used to deliver the over wrap material to the overwrap feed station. The overwrap material may be unwound with either the overwrap material coming off the top of the roll or the bottom of the roll. When the application process calls for the seal to be oriented 180 degrees from the side to which the overwrap material enters the entrance of the overwrap feed station, the overwrap material may be centered on the unwind stand so it is generally centered to the former. When the application process calls for the seal to be oriented 90 degrees (270 degrees) from the side to which the overwrap material enters the entrance of the overwrap feed station, the overwrap material may be significantly off center on the unwind stand (e.g., shifted in the direction of the center axis of rotation during unwinding of the overwrap material on the unwind stand) so it is off center to the former. The off center position of the overwrap material could be calculated in the central processing unit of the packaging line and moved automatically into position or communicated to the operator through an operator interface. The tension of overwrap material as it is unwound from the double drum unwind stand may be monitored and changed using by way of example, a load cell, a dancer roller and a potentiometer. A measuring roller may be used to pull the overwrap material from the double drum unwind stand through the dancer roller and to feed the overwrap material through the former and the overwrap feed station at a desired speed. An eye mark reader may be used to synchronize the product delivered to the entrance of the overwrap feed station with the overwrap material so that a graphic material arranged on the overwrap material may be located in a desired position on the tubular package of wrapped product.

When the product 28,128,228 is delivered to the entrance 30,130,230 of the overwrap feed station 22,122,222, the product is directed into the overwrap material at an opening in the former 60,160,260. The former 60,160,260 shapes the overwrap material 40,140,240 into a tube to enclose the bundled product. The former 60,160,260 may comprise an assembly of plates or in the alternative, the former 60,160,260 may be a single, monolithic piece. Additionally, the former 60,160,260 may have adjustability to work with multiple formats or it could be specialized for one single product format. The former may also be comprised of cables or any other mechanical structure or mechanism to form a tube from a web.

In one aspect of using the overwrap feed station, e.g., a first configuration of the overwrap feed station, a first former 60 may be used to guide the overwrap material through the entrance of the overwrap feed station such that the longitudinal seal may be formed on a horizontal face of the tubular package (for instance, as shown in FIGS. 1-5). In another aspect of using the same overwrap feed station, e.g., a second configuration of the overwrap feed station, a second former 260 may be used to guide the overwrap material through the entrance of the overwrap feed station such that the longitudinal seal may be formed on a vertical face of the tubular package (for instance, as shown in FIGS. 8-13).

A former 60,160,260 may comprise a base 64,164,264 with a cap portion 62,162,262. A base 64,164,264 of each of the formers 60,160,260 may be common but the cap portion 62,162,262 of each of the formers may be differently shaped in order to manipulate the overwrap material 40,140,240 so that the longitudinal edges of the overwrap material are arranged in an overlapping and adjacent manner on a desired location on the tubular package. The cap portion 62,162,262, of each of the formers 60,160,260 may cooperate with the common base 64,164,264. In one example, there may be two sets of bases for a particular overwrap feed station. One base may be used when the process calls for the product to be delivered to the overwrap feed station in a "cores up" (standing upright) format, and the second base may be used when the process calls for the product to be delivered to the overwrap feed station in a "cores down" (laying down) format. The first base may be used regardless of the whether the overwrap feed station is in the first configuration or second configuration, and the second base may be used regardless of the whether the overwrap feed station is in the first configuration or second configuration. Thus, the bases would not need to change based on longitudinal seal position and first and second configurations of the overwrap feed station, but the bases may change based on the incoming product orientation. In this example, the cap portions that work with particular base may change depending upon the longitudinal seal position and first and second configurations of the overwrap feed station. When the process calls for the longitudinal seal to be formed adjacent to the top or bottom horizontal supports, the cap portion of the former may use two top cap plates (one on each side, for instance, as shown in FIGS. 1-5, '62'). In distinction, when the process calls for the longitudinal seal to be formed adjacent to the left or right vertical supports, the cap portion of the former may use one top plate (for instance, as shown in FIGS. 8-13, '262'), and depending upon the application, a small, generally straight, second piece on the opposite side of the first portion (not shown). The cap portions may also change based on the incoming product orientation ("cores up" format versus a "cores down" format). Thus, depending upon the overwrap feed station configuration and the incoming product orientation ("cores up" format versus a "cores down" format), the cap portion may be comprise multiple pieces to accommodate different size products and different bundle configurations. Additionally it is possible that the base plates could be changed for different formats or longitudinal seal position. This may be done to optimize the quality of the bundle. That said, it is preferred that one base is compatible with the multiple cap portions so that when a processing application changes and the process calls for a different longitudinal seal position but the same product orientation, switching between the first and second configurations of the overwrap feed station merely involves swapping out the cap portions, and to the extent necessary, shifting the position of the unwind stand, as described above.

By way of example (see, e.g., the embodiment shown in FIGS. 1-5), for the former used to form the longitudinal seal at 180 degrees from the side to which the overwrap material 40 enters the entrance of the overwrap feed station with a "cores up" orientation of the product 28, the base 64 may comprise two base plates and the cap portion 62 may comprise two cap plates. The overwrap material wraps 40 equally around each side of the former 60 based on product width and product height. The former 60 is shaped such that the opposite longitudinal edges of the overwrap material come together at a point 180 degrees relative to the incoming path of the overwrap material into entrance of the overwrap feed station. In the embodiment of FIGS. 1-5, the base plates may be moved laterally apart and the cap plates may be moved laterally apart the same distance to accommodate a different product width. The lateral spacing between the two cap plates and the lateral spacing between the two base plates (as well as the lateral spacing between the side pull belts on the conveyor) may be adjustable by use of a hand wheel, a motor driven slide, pneumatic actuator, or mechanical spacers. In a similar manner, the cap plates may be moved vertically relative to the base plates to accommodate a different product height. The vertical spacing between the two cap plates and the two base plates (as well as the vertical spacing between the upper and lower pull belts) may be adjustable by use of a hand wheel, a motor driven slide, pneumatic actuator, or mechanical spacers. In this example, the pull belts may be extended into the former opening to receive the product. Since both sides of the former have space inside, the pull belts can grab evenly to receive the product and overwrap material and pull it through the former. Thus, depending upon the size of the product, the same former plates may be used for different wrapped product format sizes having a longitudinal seal 180 degrees from the side to which the overwrap material enters the entrance of the overwrap feed station. Should the process change and call for a "cores down" orientation of the product, a new base may be used and a new cap portion may be used, each functioning in a way similar to that described above.

Figure 13:
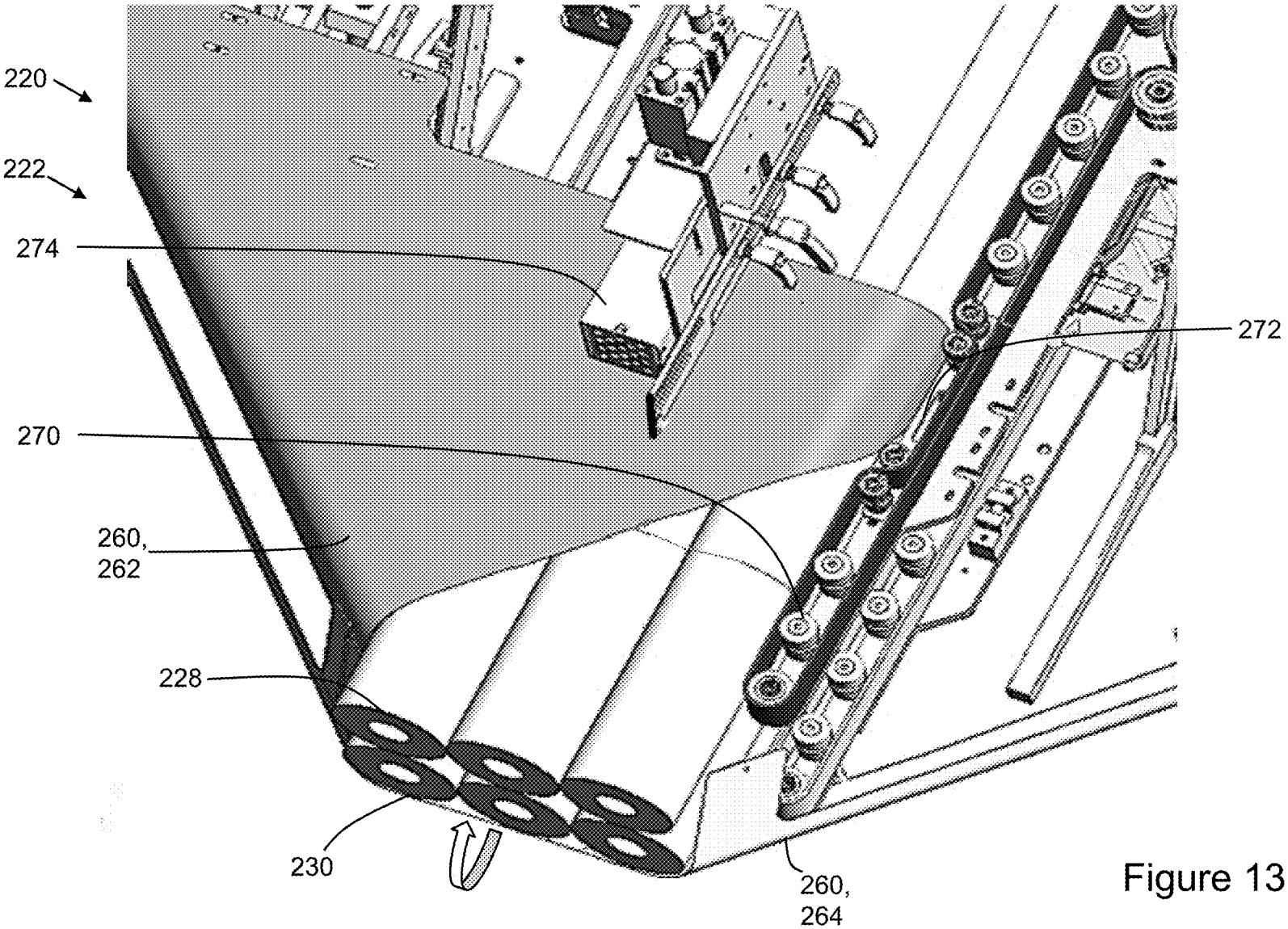
FIG. 13 is a partial perspective top view of a portion of the packaging line of FIG. 8.

By way of example (see, e.g., the embodiment shown in FIGS. 8-13), for the former 260 used to form the longitudinal seal at 90 degrees (270 degrees) from the side to which the overwrap material enters the entrance 230 of the overwrap feed station in a "cores down" orientation of the product 228, the base 264 may comprise two base plates and the cap portion 262 may comprise one cap plate. The former 260 is shaped such that the opposite longitudinal edges of the overwrap material come together at a point 90 degrees (270 degrees) relative to the incoming path of the overwrap material 240 into entrance 230 of the overwrap feed station 222. In the embodiment of FIGS. 8-13, the base plates may be moved laterally apart and a different cap plate may be used to accommodate different product widths, heights, and diameters. The lateral spacing between the two base plates (as well as the lateral spacing between the side pull belts on the conveyor) may be adjustable by use of a hand wheel, a motor driven slide, or pneumatic actuator. The vertical spacing between the cap plate and the two base plates (as well as the vertical spacing between the upper and lower pull belts) may be adjustable by use of a hand wheel, a motor driven slide, pneumatic actuator, or mechanical spacers. In this example, the pull belts may be extended into the former on only one side of the opening to receive the product. Because the other side of the former is generally open and the seal unit or heater is arranged in that position to apply the longitudinal seal, the pull belts on the side of the longitudinal seal unit or heater may be retracted out of the way. A lost motion design may be used to accommodate the space. Multiple former pieces may also be used, and changing from one mode to the other may involve manual or automated assembly of the former pieces. Automated assembly may be accomplished via pneumatic or motorized actuators. Additionally, a secondary assembly may be mounted in front (i.e., upstream) of the location of and on the same side as the longitudinal sealer to help receive and contain the product as it enters the former. As seen in FIG. 8, there is a significant gap between the top and bottom plate on the right side, and a secondary assembly may be used to capture that product and help move it through the former. The secondary assembly may be a small belt assembly driven from other belts in the area. The secondary assembly may also comprise a small guide plate with roller wheels or beads. The secondary assembly may comprise a housing with a drive for driving a set of smaller belts integrated with the longitudinal seal unit. Alternatively, as shown in FIG. 13, a belt driven assembly 270 may be moved in a direction laterally toward the product flow and the opening of the former into the gap between the top and bottom plate 262,264 on the right side of the former 260. For a configuration as shown in FIGS. 1-7, the belt driven assembly may be moved in a direction toward the inlet of the former to capture the product as soon as possible. In the configuration as shown in FIGS. 8-13, the belt driven assembly 270 may have sections 272 that are arranged to create a lateral spacing between the belt and the product which allows the bottom part of the cap plate (e.g., the portion extending downward just before the seal unit) to fit between product and the belt of the belt driven assembly 270. The section 272 (and thus the spacing) may be adjustable in width or position to accommodate different sizes of cap plates and bottom plates, and different product sizes and formats. The belt driven assembly may reduce the number of different parts required for different product sizes and formats, and may reduce set-up time in changing the packaging line and overwrap feed station from one format to another. Thus, depending upon the height of the product, the same cap plate and base plates may be used for different wrapped product format height sizes having a longitudinal seal 90 degrees (270 degrees) from the side to which the overwrap material enters the entrance of the overwrap feed station. Should the process change and call for a "cores up" product orientation, a new base may be used and a new cap portion may be used, each functioning in a way similar to that described above.

Generally speaking, in both embodiments of FIGS. 1-7 and 8-13, the longitudinal seal 44,144,244 unit may be manually or automatically adjusted for height and may be manually or automatically adjusted in the direction of the movement the product as it is being moved through the hollow interior of the enclosure. One longitudinal seal 44,144,244 unit may be provided and may be oriented as needed to provide the longitudinal seal on the desired side of the package. The longitudinal seal 44,144,244 unit may be disposed on a mechanism that indexes from a position adjacent the top horizontal support of the overwrap feed station and moves 90 degrees to a position adjacent one of the left and right vertical supports of the overwrap feed station. This index movement could be performed by a motorized assembly that allows the longitudinal seal unit 44,144,244 to pivot to either location and to move in a secondary actuation direction that allows the longitudinal seal unit to be brought to a close distance to the path of the overwrap material 40,140,240. The index movement may be performed manually or via a rotary actuator. Alternatively, a second longitudinal seal unit (see, e.g, FIGS. 8-13, '274') may be provided with one longitudinal seal unit 274 arranged adjacent the top horizontal support of the overwrap feed station and used for applying the longitudinal seal 180 degrees from the side to which the overwrap material enters the entrance of the overwrap feed station and the other longitudinal seal unit 244 arranged adjacent the left and/or right vertical horizontal support of the overwrap feed station and used for applying the longitudinal seal 90 degrees (270 degrees) from the side to which the overwrap material enters the entrance of the overwrap feed station. The longitudinal seal unit that is not used for the application process may be moved to a disengaged position. For instance, as shown in FIGS. 8-13, the second longitudinal seal unit 274 is moved out of position. For desired movement or disengagement from use, a longitudinal seal unit may be moved manually, with a motor driven slide, or via pneumatic actuator.

During normal operation of the packaging line 20,120,220 and overwrap feed station 22,122,222, the overwrap material 40,140,240 is directed from the unwind stand 50, pulled around the outside of the former 60,160,260 and then through an opening of the former into the entrance 30,130,230 of the overwrap feed station to form a tube around the product 28,128,228 and the tube of overwrap material around the product is sealed by the longitudinal sealer (not shown). A vacuum lance (not shown) may be used to extract any air from the bundle that was introduced and as a backing for formation of the longitudinal seal preventing the overwrap material from melting onto the product during heating to form the longitudinal seal. Additionally, a passive means of allowing the air to exit the bundle may be used, such as holes punched in the film upstream. The upper and lower end seal dies (not shown) may be disposed at the discharge 32,132,232 of the overwrap feed station 22,122,222 to form end seals in the tubular wrapped product. Mechanical tuckers (not shown) or an air blast (not shown) may be disposed at the discharge 32,132,232 of the overwrap feed station 22,122,222 to form the gussets in the tubular package. A plunge knife (not shown), or a knife that is either mechanically or pneumatically actuated (not shown), may be disposed at the discharge 32,132,232 of the overwrap feed station 22,122,222 to cut adjacent bundles of the tubular packages at the end seals. A separate cut and seal ribbon may also be used to separate the tube and seal the ends together.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A method of wrapping a product in a overwrap feed station, wherein the overwrap feed station is adapted and configured for wrapping the product with an overwrap material, the overwrap feed station has an entrance and a discharge, the overwrap feed station entrance is adapted and configured to be arranged with first and second formers, the overwrap feed station is adapted and configured to draw the overwrap material around the product and to form a tube of the overwrap material around the product as the product is being moved from the entrance to the discharge, each of the first and second formers has an opening, each of the formers is adapted and configured to receive the overwrap material through the opening of each former and guide the overwrap material through the entrance of the overwrap feed station when installed on the entrance of the overwrap feed station the first former is adapted and configured to guide the overwrap material through the entrance of the overwrap feed station in a manner such that during wrapping of the product, longitudinal edges of the overwrap material overlap on, and are further sealed onto a longitudinal first side of the tube, and the second former is adapted and configured to guide the overwrap material through the entrance of the overwrap feed station in a manner such that during wrapping of the product, longitudinal edges of the overwrap material overlap on, and are further sealed onto a longitudinal second side of the tube, wherein the longitudinal second side of the tube is transverse to the longitudinal first side of the tube, the method comprising:

configuring the overwrap feed station in one of a first configuration by installing the first former at the entrance of the overwrap feed station and a second configuration by installing the second former at the entrance of the overwrap feed station based upon a desired location of a longitudinal seal on the tube of the overwrap material around the product.

2. The method of claim 1 wherein the overwrap feed station comprises first and second longitudinal sealers, and the method further comprises:

when in the first configuration, arranging the first longitudinal sealer adjacent to the first side of the tube; and when in the second configuration arranging the second longitudinal sealer adjacent to the second side of the tube.

3. The method of claim 1 wherein the overwrap feed station comprises a longitudinal sealer, and the method further comprises:

when in the first configuration, arranging the longitudinal sealer adjacent to the first side of the tube; and when in the second configuration, arranging the longitudinal sealer adjacent to the second side of the tube.

4. The method of claim 1 wherein each of the first and second formers comprises a cap portion and a base portion; and the step of installing the one of the first former and the second former comprises:

when in the first configuration, installing the cap portion of the first former with the base portion of the first former wherein the base portion of the first former is one of different from and the same as the base portion of the second former; and when in the second configuration, installing the cap portion of the second former with the base portion of the second former wherein the base portion of the second former is one of different from and the same as the base portion of the first former.

5. The method of claim 1 further comprising:

moving the product through the opening of the one of the first and second formers;

directing the overwrap material to the opening of the one of the first and second formers; and sealing the overlapped longitudinal edges of the overwrap material with the product in a tube of the overwrap material.

6. The method of claim 5 wherein the step of directing the overwrap material to the opening of the one of the first and second formers comprises directing the overwrap material to travel in a same direction for each of the first and second configurations.

7. The method of claim 6 wherein the step of directing the overwrap material to the opening of the one of the first and second formers comprises:

when in the first configuration, aligning the overwrap material relative to the opening of the first former in a manner such that the longitudinal edges of the overwrap material overlap on the first longitudinal side of the tube during wrapping of the product; and when in the second configuration, aligning the overwrap material relative to the opening of the second former in a manner such that the longitudinal edges of the overwrap material overlap on the second longitudinal side of the tube during wrapping of the product.

8. The method of claim 6 wherein the step of directing the overwrap material to the opening of the one of the first and second formers comprises:

unwinding a roll of the overwrap material about a same center axis for each of the first and second configurations.

9. The method of claim 8 wherein the step of unwinding the roll of the overwrap material includes moving the roll of the overwrap material between first and second positions along the center axis, wherein in the first position of the roll of the overwrap material, the overwrap material is positioned relative to the opening of the first former in the first configuration such that the that longitudinal edges of the overwrap material overlap on the first longitudinal side of the tube during wrapping of the product, and wherein in the second position of the roll of overwrap material, the overwrap material is positioned relative to the opening of the second former in the second configuration such that the that longitudinal edges of the overwrap material overlap on the second longitudinal side of the tube during wrapping of the product.

10. A method of wrapping a product with an overwrap material in a packaging line comprising an overwrap feed station, wherein the overwrap feed station has left and right vertical supports, and bottom and top horizontal supports defining an enclosure with a hollow interior for the overwrap feed station, the overwrap feed station has an entrance and a discharge, the overwrap feed station entrance is adapted and configured to be arranged with first and second formers, the overwrap feed station is adapted and configured to draw the overwrap material around the product and to form a tube of the overwrap material around the product as the product is being moved from the entrance to the discharge, each of the first and second formers has an opening, each of the formers is adapted and configured to receive the overwrap material through the opening of each former and guide the overwrap material through the entrance of the overwrap feed station when installed on the entrance of the overwrap feed station, the first former is adapted and configured to guide the overwrap material through the entrance of the overwrap feed station in a manner such that during wrapping of the product, longitudinal edges of the overwrap material overlap adjacent to one of the left and right vertical supports and are further sealed onto a left or right vertical side of the tube, and the second former is adapted and configured to guide the overwrap material through the entrance of the overwrap feed station in a manner such that during wrapping of the product, longitudinal edges of the overwrap material overlap adjacent to one of the top and bottom horizontal supports and are further sealed onto a top or bottom horizontal side of the tube, the method comprising:

configuring the overwrap feed station in one of a first configuration by installing the first former at the entrance of the overwrap feed station and a second configuration by installing the second former at the entrance of the overwrap feed station based upon a desired location of a longitudinal overlapping seal to be formed on the tube of the overwrap material around the product including:

when in one of the first and the second configuration, arranging the overwrap material to travel to the opening of the first former such that the overwrap material is positioned relative to the opening of the first former in a manner such that the longitudinal edges of the overwrap material overlap adjacent to one of the left and right vertical supports during moving and wrapping of the product, the longitudinal edges being further sealed onto the left or right vertical side of the tube; and when in the other of the first and the second configuration, arranging the overwrap material to travel to the opening of the second former such that the overwrap material is positioned relative to the opening of the second former in a manner such that longitudinal edges of the overwrap material overlap adjacent to one of the top and bottom horizontal supports during moving and wrapping of the product, the longitudinal edges being further sealed onto the top or bottom horizontal side of the tube;

wherein for each of the first and second configurations, the overwrap material prior to engaging the respective first and second former travels in a same direction.

11. The method of claim 10 wherein the overwrap feed station comprises first and second longitudinal sealers, and the method further comprises:

when in the first configuration, arranging the first longitudinal sealer adjacent to one of the left and right vertical supports to seal the overlapping longitudinal edges of the overwrap material; and when in the second configuration arranging the second longitudinal sealer adjacent to one of the top and bottom horizontal supports to seal the overlapping longitudinal edges of the overwrap material.

12. The method of claim 10 wherein the overwrap feed station comprises a longitudinal sealer, and the method further comprises:

when in the first configuration, arranging the longitudinal sealer adjacent to one of the left and right vertical supports to seal the overlapping longitudinal edges of the overwrap material; and when in the second configuration arranging the longitudinal sealer adjacent to one of the left and right vertical supports to seal the overlapping longitudinal edges of the overwrap material.

13. The method of claim 10 wherein each of the first and second formers comprises a cap portion and a base portion; and the step of installing the one of the first former and the second former comprises:

when in the first configuration, installing the cap portion of the first former with the base portion of the first former wherein the base portion of the first former is one of different from and the same as the base portion of the second former; and when in the second configuration, installing the cap portion of the second former with the base portion of the second former wherein the base portion of the second former is one of different from and the same as the base portion of the first former.

14. The method of claim 10 further comprising:

moving the product through an opening of the one of the first and second formers;

directing the overwrap material to the opening of the one of the first and second formers; and sealing the overlapped longitudinal edges of the overwrap material with the product in a tube of the overwrap material.

15. The method of claim 14 further comprising unwinding a roll of the overwrap material about a same center axis for each of the first and second configurations.

16. The method of claim 15 wherein the step of unwinding the roll of the overwrap material includes moving the roll of the overwrap material between first and second positions along the center axis wherein in the first position of the roll of the overwrap material, the overwrap material is positioned relative to the opening of the first former in the first configuration such that the that longitudinal edges of the overwrap material overlap adjacent to the left and right vertical supports during wrapping of the product, and wherein in the second position of the roll of overwrap material, the overwrap material is positioned relative to the opening of the second former in the second configuration such that the that longitudinal edges of the overwrap material overlap adjacent to the top and bottom horizontal supports during wrapping of the product.

17. A method of wrapping a product in an overwrap feed station, wherein the overwrap feed station is adapted and configured for wrapping the product with an overwrap material, the overwrap feed station has an entrance and a discharge, the overwrap feed station entrance is adapted and configured to be arranged with a former in first and second orientations, the overwrap feed station is adapted and configured to draw the overwrap material around the product and to form a tube of the overwrap material around the product as the product is being moved from the entrance to the discharge, the former has an opening, the former is adapted and configured to receive the overwrap material through the opening of the former in each of the first and second orientations of the former and guide the overwrap material through the entrance of the overwrap feed station, the method comprising:

installing the former on the entrance of the overwrap feed station in the first orientation of the former relative to the entrance of the overwrap feed station, wherein in the first orientation of the former relative to the entrance of the overwrap feed station, the former is adapted and configured to guide the overwrap material through the entrance of the overwrap feed station in a manner such that during wrapping of the product, longitudinal edges of the overwrap material overlap on, and are further sealed onto a first longitudinal side of the tube; and installing the former on the entrance of the overwrap feed station in the second orientation of the former relative to the entrance of the overwrap feed station, wherein in the second orientation of the former relative to the entrance of the overwrap feed station, the former is adapted and configured to guide the overwrap material through the entrance of the overwrap feed station in a manner such that during wrapping of the product, longitudinal edges of the overwrap material overlap on, and are further sealed onto a second longitudinal side of the tube, wherein the second side of the tube is transverse to the first side of the tube.

18. The method of claim 17 wherein the overwrap feed station comprises a longitudinal sealer, and the method further comprises:

when in the first configuration, arranging the longitudinal sealer adjacent to the first side of the tube; and when in the second configuration, arranging the longitudinal sealer adjacent to the second side of the tube.

19. The method of claim 17 further comprising:

moving the product through an opening of the former in one of the first and second orientations of former relative to the entrance of the overwrap feed station;

directing the overwrap material to the opening of the former; and sealing the overlapped longitudinal edges of the overwrap material with the product in a tube of the overwrap material.

20. The method of claim 19 wherein the step of directing the overwrap material to the opening of the former comprises directing the overwrap material to travel in a same direction for each of the first and second configurations.

21. The method of claim 20 wherein the step of directing the overwrap material to the opening of the former comprises:

unwinding a roll of the overwrap material about a same center axis for each of the first and second configurations.

22. The method of claim 21 wherein the step of unwinding the roll of the overwrap material includes moving the roll of the overwrap material between first and second positions along the center axis, wherein in the first position of the roll of the overwrap material, the overwrap material is positioned relative to the opening of the former in the first orientation such that the that longitudinal edges of the overwrap material overlap on the first longitudinal side of the tube during wrapping of the product, and wherein in the second position of the roll of overwrap material, the overwrap material is positioned relative to the opening of the former in the second orientation such that the longitudinal edges of the overwrap material overlap on the second longitudinal side of the tube during wrapping of the product.

* * * * *